US006402289B2

(12) United States Patent
Nitta

(10) Patent No.: US 6,402,289 B2
(45) **Date of Patent: *Jun. 11, 2002**

(54) LIQUID JET APPARATUS WITH A DRIVE SOURCE FOR DRIVING A CAP AND A SUCTION DEVICE

(75) Inventor: Tetsuhiro Nitta, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/781,059

(22) Filed: Jan. 9, 1997

(30) Foreign Application Priority Data

Jan. 10, 1996 (JP) ..... 8-001847

(51) Int. Cl.[7] ..... B41J 2/165
(52) U.S. Cl. ..... 347/30; 347/32
(58) Field of Search ..... 347/30–33; 412/360, 412/361

(56) References Cited

U.S. PATENT DOCUMENTS

| | | | | |
|---|---|---|---|---|
| 4,695,851 A | | 9/1987 | Terasawa | 347/30 |
| 4,745,414 A | | 5/1988 | Okamura et al. | 347/30 |
| 5,126,766 A | | 6/1992 | Terasawa et al. | 347/30 |
| 5,138,343 A | | 8/1992 | Aichi et al. | 347/30 |
| 5,371,531 A | * | 12/1994 | Rezanka et al. | 347/100 |
| 5,587,729 A | * | 12/1996 | Lee et al. | 347/32 |
| 5,625,385 A | * | 4/1997 | Suzuki | 347/24 |
| 5,959,641 A | * | 9/1999 | Yokoi | 347/21 |
| 5,975,676 A | | 11/1999 | Saijo | 347/22 |

FOREIGN PATENT DOCUMENTS

| | | | | |
|---|---|---|---|---|
| EP | 0495669 A1 | | 1/1992 | |
| EP | 0526209 A2 | | 7/1992 | |
| EP | 0540344 | | 5/1993 | |
| EP | 0575153 | | 12/1993 | |
| EP | 0 576 175 | * | 12/1993 | |
| JP | 6-262768 | | 9/1994 | |
| JP | 40701061 A | * | 1/1995 | 347/30 |
| JP | 7-132617 | | 5/1995 | |

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

A liquid jet apparatus includes a recording head for discharging a recording liquid from a nozzle, a cap for capping the nozzle of the recording head, a suction device for sucking the recording liquid from the nozzle when the nozzle is capped, and a drive source used specially for driving the cap and the suction device. The drive source is driven in one direction in order to cause the cap to cap the nozzle, and is driven in a direction opposite to the one direction to cause the suction device to perform sucking.

13 Claims, 20 Drawing Sheets

CAP OPERATION

TUBE PUMP OPERATION

CAP OPERATION

TUBE PUMP OPERATION

CAP OPERATION

TUBE PUMP OPERATION, SUCTION POSITION

AT HOME POSITION

LIQUID JET APPARATUS WITH A DRIVE SOURCE FOR DRIVING A CAP AND A SUCTION DEVICE

BACKGROUND OF THE INVENTION

1. Field of the Invention

The present invention relates to a liquid jet apparatus (hereinafter also referred to as "inkjet apparatus") which performs recording by discharging a recording liquid to a recording medium from a recording means, and a recovery device used for increasing the reliability of the liquid jet head (hereinafter also referred to as "inkjet head"). In the present invention, recording medium not only represents paper, but also represents textiles and three-dimensional media.

2. Description of the Related Art

A conventional inkjet recording apparatus comprises a recording head which performs recording by discharging a recording liquid, such as ink, to a recording medium from a nozzle (discharging opening). Therefore, the ink, when left in the nozzle for a certain period of time, gets clogged in the nozzle, which prevents printing or proper printing. Accordingly, it is necessary to constantly prevent ink clogging in the head in order to preserve good recording quality. To prevent ink clogging, conventional recording apparatuses of this type are provided with capping means and suction pressure generating means, as recovery means for overcoming ink clogging of the nozzle. The capping means caps the nozzle, while the suction pressure generating means forcefully sucks ink from the nozzle when it is capped.

The capping means and the suction pressure generating means are operated by drive power from a drive system for driving a carriage carrying an inkjet head and reciprocating in the main scanning dimension, or by drive power from a drive system for conveying a recording medium.

However, using the drive power of the aforementioned drive systems to operate the capping means and the suction pressure generating means increases the number of component parts and requires a complicated switching mechanism for switching from one drive system to another.

SUMMARY OF THE INVENTION

Accordingly, an object of the present invention is to provide a highly reliable inkjet recording apparatus which uses fewer component parts, has a simple structure and is reduced in size, and a recovery apparatus for use in the recording apparatus.

Another object of the present invention is to provide a liquid jet apparatus, comprising: a recording head for discharging a recording liquid from a nozzle; a cap for capping the nozzle of the recording head; suction means for sucking the recording liquid from the nozzle, when the nozzle is capped; and a drive source used specially for driving the cap and the suction means; wherein the drive source is driven in one direction in order to cap the cap, and is driven in the opposite direction to cause the suction means to perform the suction.

A further object of the present invention is to provide a recovery apparatus for use in the liquid jet apparatus comprising a recording head for discharging a recording liquid from a nozzle, a cap for capping the nozzle, suction means for sucking the recording liquid from the nozzle when the nozzle is capped, and a drive source used specially for operating the cap and the suction means, wherein the drive source is driven in one direction in order to cap the cap, and is driven in the opposite direction to cause the suction means to perform the suction.

According to the present invention, capping or sucking can be performed by simply switching the driving direction of the drive source, resulting in a fewer number of component parts, a simpler structure, and increased reliability.

In addition, since the construction allows the recording liquid of a plurality of heads to be sucked simultaneously at one time as well as separately, ink is not wasted, running costs are reduced, and the required capacity of the waste ink container is minimized, so that the apparatus is further reduced in size.

BRIEF DESCRIPTION OF THE DRAWINGS

FIG. 5A shows the caps removed from their respective nozzles, while FIG. 5B shows the caps capping their respective nozzles.

FIG. 6A shows black ink being sucked, FIG. 6C shows color ink being sucked.

FIG. 8A shows the processing liquid recording head portion being wiped, FIGS. 8B and 8C show color ink recording head portions being wiped.

FIG. 14A shows the caps capping their respective nozzles. FIG. 14B shows the caps removed from their respective nozzles.

FIG. 15A shows the processing liquid being sucked, while FIG. 15B shows the yellow ink being sucked.

FIG. 16A shows magenta ink being sucked by means of the yellow cap, FIG. 16B shows cyan ink being sucked by means of the same cap, and FIG. 16C shows black ink being sucked by means of the same cap.

DESCRIPTION OF THE PREFERRED EMBODIMENTS

A description will now be given of the preferred embodiments with reference to the drawings.

Embodiment 1

Figure 1:
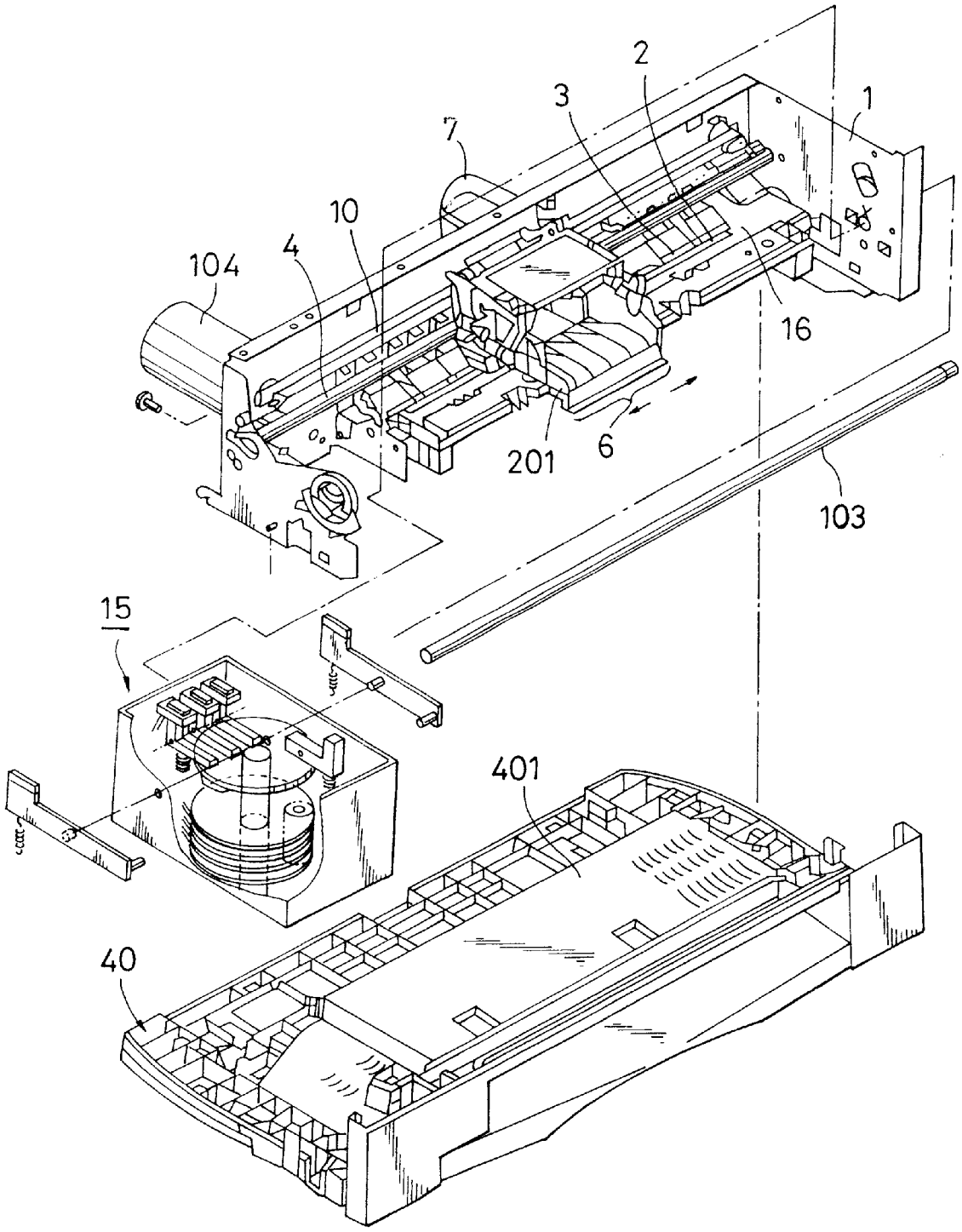
FIG. 1 is an exploded perspective view of an inkjet recording apparatus of Embodiment 1 of the present invention.
Figure 2:
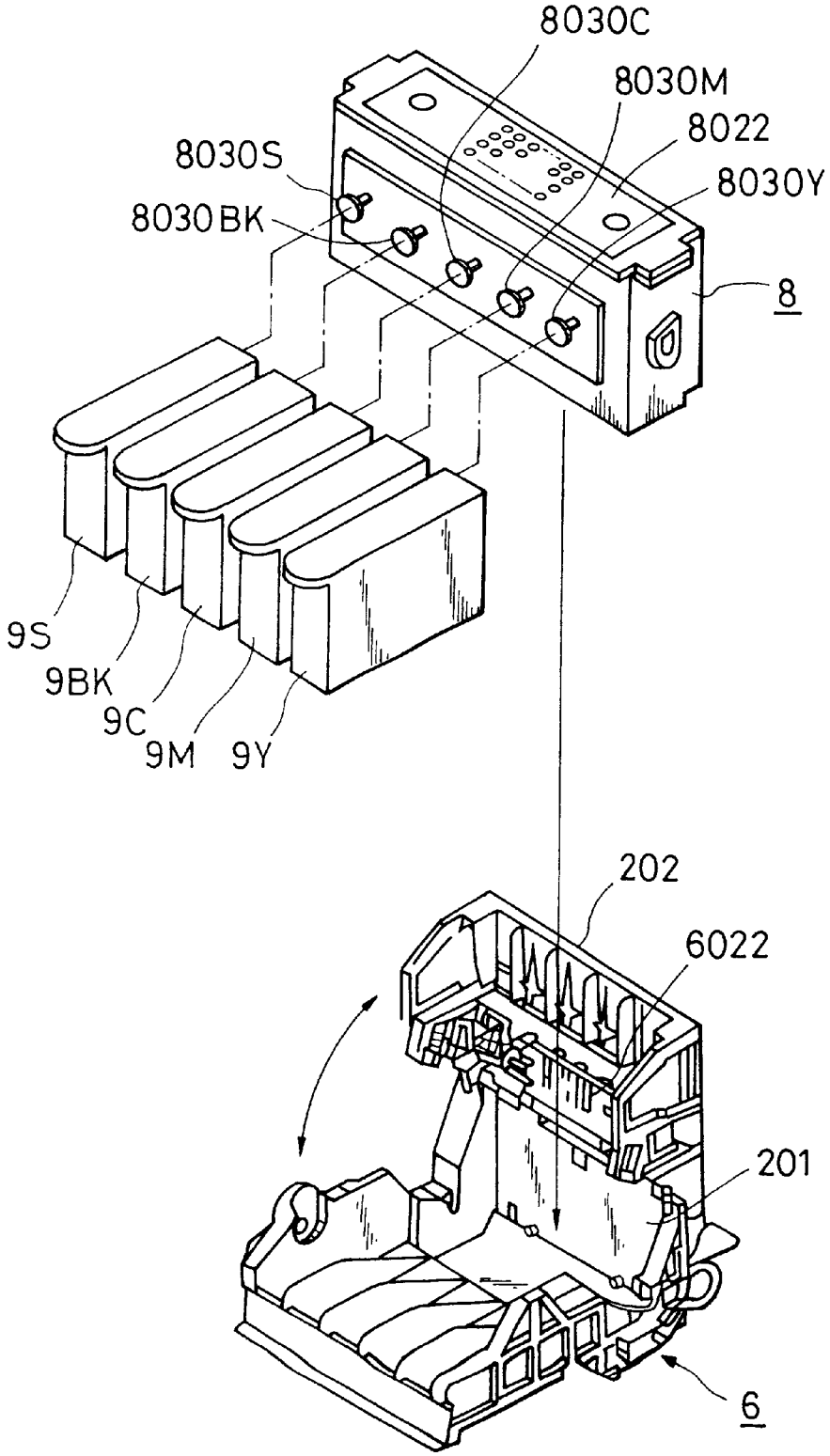
FIG. 2 is an exploded perspective view of the carriage, the recording head capable of being carried by the carriage, and the ink tanks of the inkjet recording apparatus of Embodiment 1 of the present invention.
Figure 3:
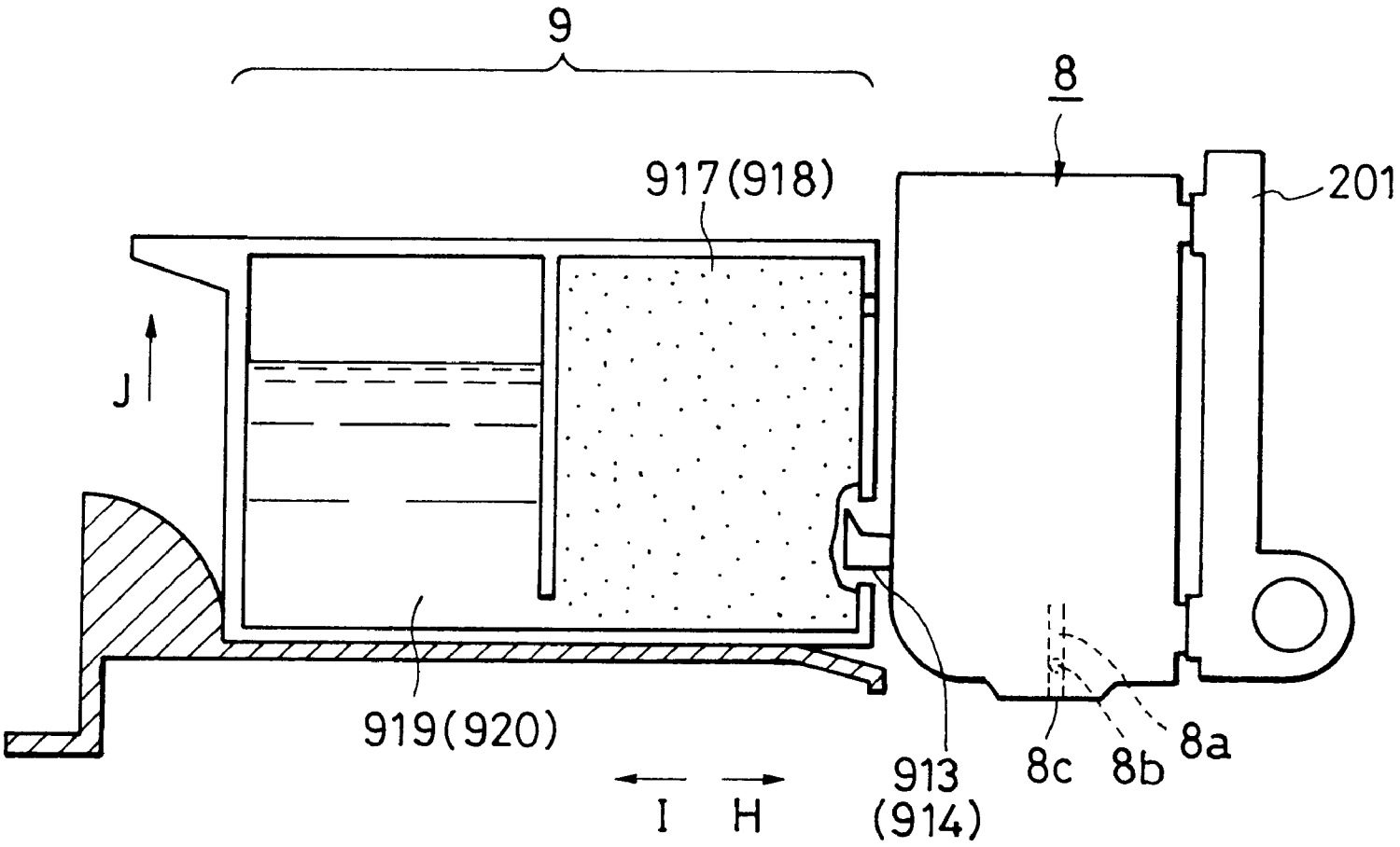
FIG. 3 is a schematic front elevational view of the recording section and the liquid supply system of the inkjet recording apparatus of Embodiment 1 of the present invention.

FIG. 1 is an exploded perspective view of an embodiment of the inkjet recording apparatus of the present invention. FIG. 2 is an exploded perspective view of the carriage, the recording head capable of being mounted onto the carriage, and the ink tanks. FIG. 3 is a schematic front elevational view of the recording section and the liquid supply system.

As shown in FIGS. 1 to 3, the inkjet recording apparatus of the present embodiment comprises a carriage 6 which is capable of carrying a recording head 8, a processing liquid ink tank 9S, and color ink tanks 9BK, 9C, 9M, and 9Y. In the specification, the term ink is sometimes used to mean processing liquid.

In the present embodiment, the processing liquid ink tank, the yellow ink tank, the magenta ink tank, the cyan ink tank, and the black ink tank can all be replaced separately. Here, the processing liquid used contains a cationic substance of high molecular and low molecular weight components, while the ink used contains anionic dye, which becomes insoluble when it is mixed with the processing liquid.

The construction of the recording head 8 includes a black nozzle, a processing liquid nozzle, and a color nozzle, which are integrally formed in a row. Of these nozzles, the color nozzle unit comprises a yellow nozzle, a magenta nozzle, and a cyan nozzle, which are integrally formed in a vertical row.

The carriage 6 primarily comprises a carriage base 201 and a head lever 202. The recording head 8, the processing liquid tank 9S, and the color ink tanks 9BK, 9C, 9M, and 9Y are positioned and carried by the carriage base 201. The head lever 202 holds the recording head 8 on the carriage base 201.

A connector 8022 is disposed at the top portion of the recording head 8 in order to receive signals, such as those to drive the recording head, and is electrically connected to a connector 6022 on the carriage 6.

The recording head 8 is provided with five ink supply openings 8030 for supplying ink from the processing liquid ink tank 9S, and each of the color ink tanks 9BK, 9C, 9M, and 9Y. (The ink supply openings are, from the left side of FIG. 2, the processing liquid supply opening 8030S, the black ink supply opening 8030BK, the cyan ink supply opening 8030C, the magenta ink supply opening 8030M, and the yellow ink supply opening 8030Y.) From these openings, the ink flows through an ink flow path 8*a* in the head and into each of the nozzles 8*c* of the head. An electrothermal conversion member 8*b* is provided in the flow path 8*a* in order to generate thermal energy in order to discharge the ink from each of the nozzles 8*c*.

The processing liquid tank 9S, and the color ink tanks 9BK, 9C, 9M, and 9Y are each provided with ink supply openings 913 and 914 which connect with the recording head 8 (FIG. 3). Each of the ink tanks 9S, 9BK, 9C, 9M, and 9Y have two chambers in their interior, a front chamber containing absorption members 917 and 918, and a back chamber containing processing liquid 920 or raw ink 919, as viewed from the supply openings 913 and 914. Such an ink tank is called a half-life type ink tank.

Referring to FIG. 1, a guide shaft 4 and a support shaft 103, both of which slidably supports the carriage 6, are mounted to the side walls of a substantially C-shaped chassis 1 of the apparatus. Via a timing belt 10, a carriage motor 104 provides the drive power for allowing the carriage 6 to reciprocate in the main scanning dimension along both of the aforementioned shafts.

The recording medium (not shown), such as paper, is nipped between a platen roller 2 and a pinch roller 3 (both of which are shown in FIG. 1) to convey the recording medium onto a platen 16. At this time, a head section (not shown) of the recording head 8 carried by the carriage 6 protrudes downwardly from the carriage 6 such that the discharging opening face of the head section is disposed parallel to and in opposing relation to the recording medium (not shown) on the platen 16.

Figure 4:
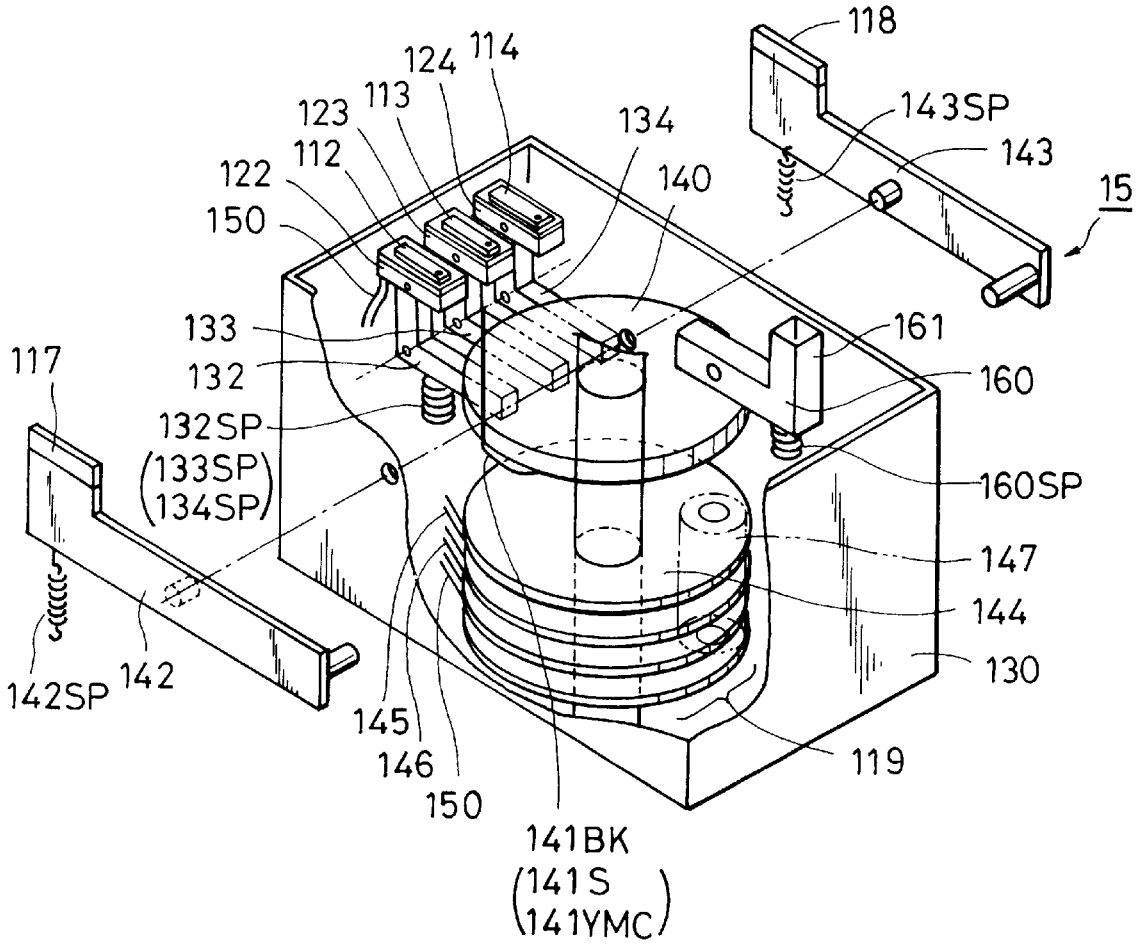
FIG. 4 is an exploded perspective view of the construction of the recovery system unit of the inkjet recording apparatus of Embodiment 1 of the present invention.

A recovery system unit 15 is disposed at the home position side of the apparatus (at the left of the print region of FIG. 1). FIG. 4 is a perspective view of the recovery system unit 15.

The recovery system unit 14 is provided with a black cap 112, a processing liquid cap 113, and a color cap 114 for the black color nozzle, the processing liquid nozzle, and the color nozzle unit, respectively. The aforementioned caps are used to suck recording liquid and to merely cap their respective nozzles when recording liquid is not being sucked.

As shown in FIG. 4, the caps 112, 113, and 114 are supported by cap holders 122, 123, and 124, respectively. The holders 122, 123, and 124 are fixed to one end of cap levers 132, 133, and 134, respectively. The cap levers 132, 133, and 124 are axially and rotatably secured to the recovery base 130. Accordingly, the capping means comprises caps, cap holders, and cap levers.

The cap levers 132, 133, and 134 are urged by cap lever springs 132SP, 133SP, and 134SP, respectively. The cap levers 132, 133, and 134 partly contact their respective cam faces 141BK, 141S, and 141YMC of a suction cam 140 functioning as capping control means. Accordingly, when the suction cam 140 rotates, the cap levers 132, 133, and 134 move rotationally in the vertical dimension, causing each of the caps 112, 113, and 114 to move vertically.

The black cap 112, the processing liquid cap 113, and the color cap 114 communicate with their respective tubes 150, 146, and 145 of a pump unit 119 via their respective cap holders 122, 123, and 124. When improper discharge from the recording head 8 occurs, the pump unit 119 causes the cap unit to contact the recording head in order generate a negative pressure during suction recovery operations performed to suck ink from the discharge opening of the recording head. In the present embodiment, the pump unit 119, used as the suction pressure generating means, is a tube pump.

The pump unit 119 comprises a black ink tube 150, a processing liquid tube 146, a color ink tube 145, a roller holder 144, a pressure roller member 147, and a pressure guide (not shown) of the recovery system base 130. The roller holder 144 is axially and rotatably secured to the recovery system base 130. Negative pressure is generated within the caps as the tubes 150, 145, and 146, guided by the roller holder 144, are squashed by the pressure roller 147 axially secured to the roller holder 144, and by a pressure guide (not shown).

Waste liquid from each ink tank is separately sent to a waste ink tank 401 (FIG. 1) of a body 40 through its associated liquid path so as to prevent the ink from becoming insoluble in the pump due to mixing of the recording color ink and the processing liquid within the cap or pump.

Figure 5A:
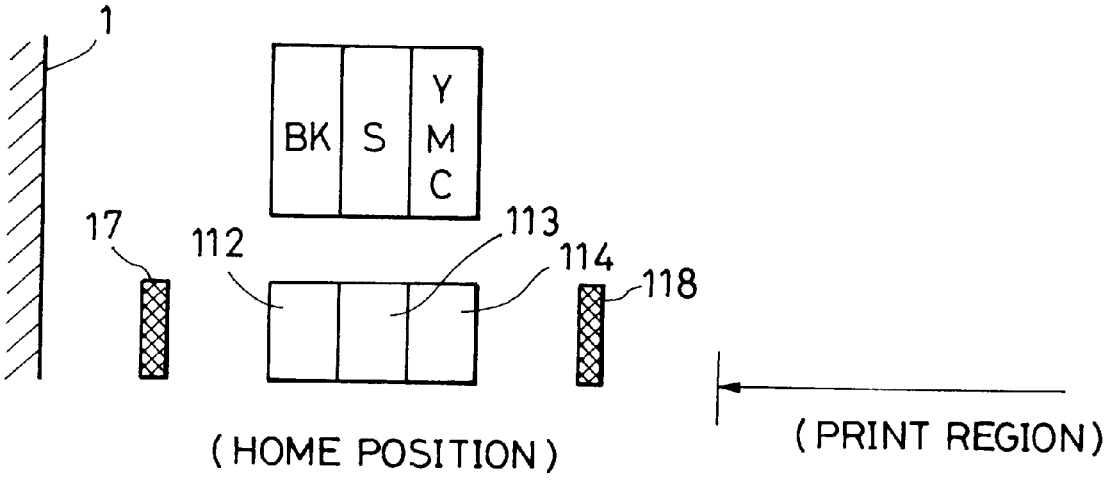
FIGS. 5A and 5B illustrate the operation of the recovery system of the inkjet recording apparatus of Embodiment 1 of the present invention.
Figure 5B:
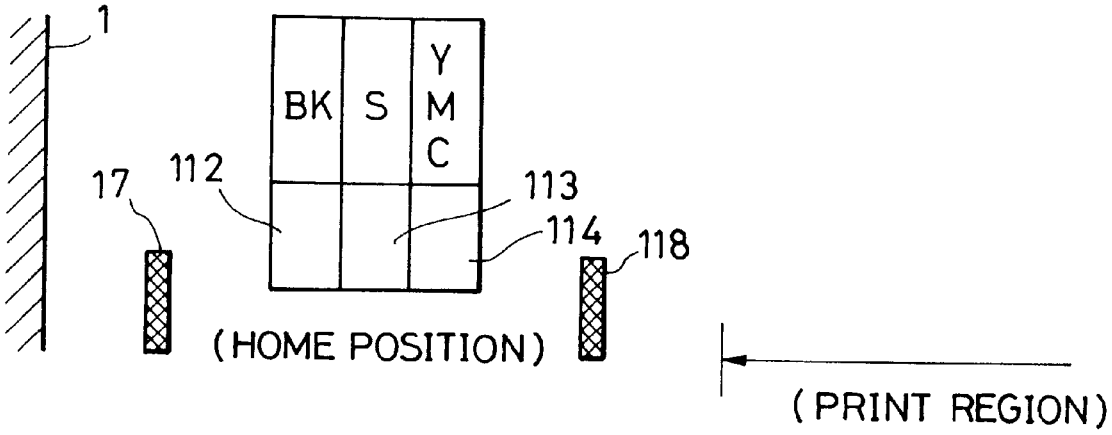
Figure 6A:
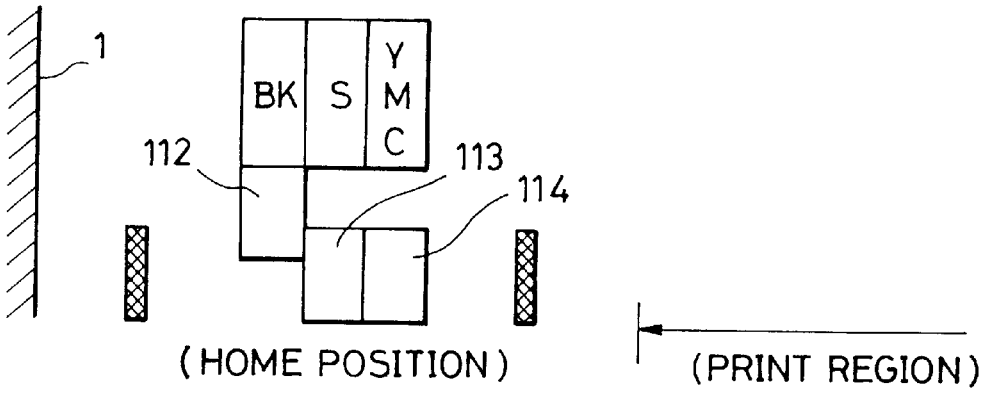
FIGS. 6A and 6C illustrate the operation of the recovery system of the inkjet recording apparatus of Embodiment 1 of the present invention.
Figure 6B:
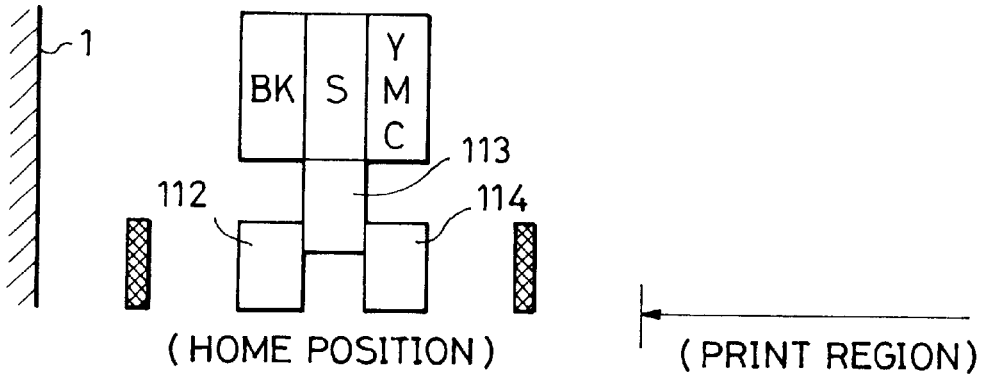
FIG. 6B shows processing liquid being sucked.
Figure 6C:
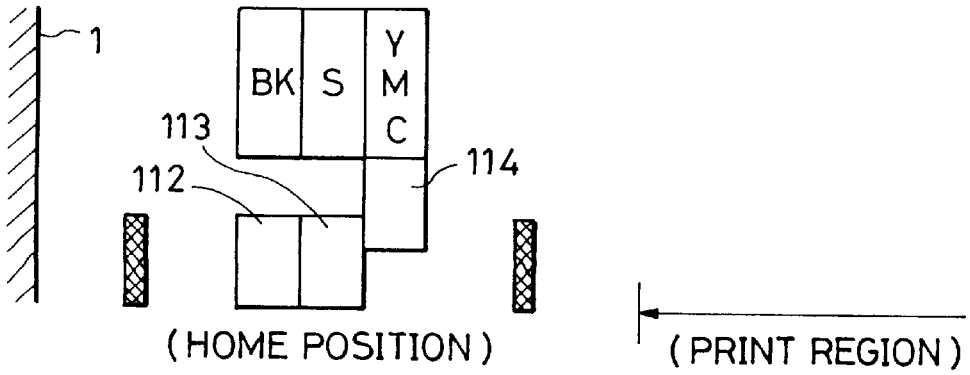

FIG. 5A illustrates the caps removed from their respective nozzles. FIG. 5B illustrates a state in which the caps cap their respective nozzles. FIG. 6A illustrates blank ink being sucked. FIG. 6B illustrates processing liquid being sucked. FIG. 6C illustrates color ink being sucked.

As shown in FIGS. 5A to 6C, when the carriage is at home position, the processing liquid and color liquid recording head portions are capped, so that the recording ink and the processing liquid will not mix at the vicinity of the discharging opening face of the recording head 8 and solidify.

As shown in FIG. 5B, when the recording head is at home position and is in a waiting state for more than a certain period of time, all of the recording head portions are capped in order to prevent improper discharging of ink caused by increased viscosity or solidification occurring when ink in the discharging opening of the recording head evaporates. With all of the recording head portions capped, operation of the tube pump allows suction to be performed simultaneously at one time at all of the recording head portions.

As shown in FIG. 5A, during printing, all of the nozzles are uncapped. With all of the nozzles uncapped, idle suction can be performed, even during printing, by operating the tube pump. Preliminary discharge is performed to each cap while the nozzles are in an uncapped state. Then, the tube pump is operated to perform idle suction of only the ink which has collected within the cap by preliminary discharge.

Figure 7:
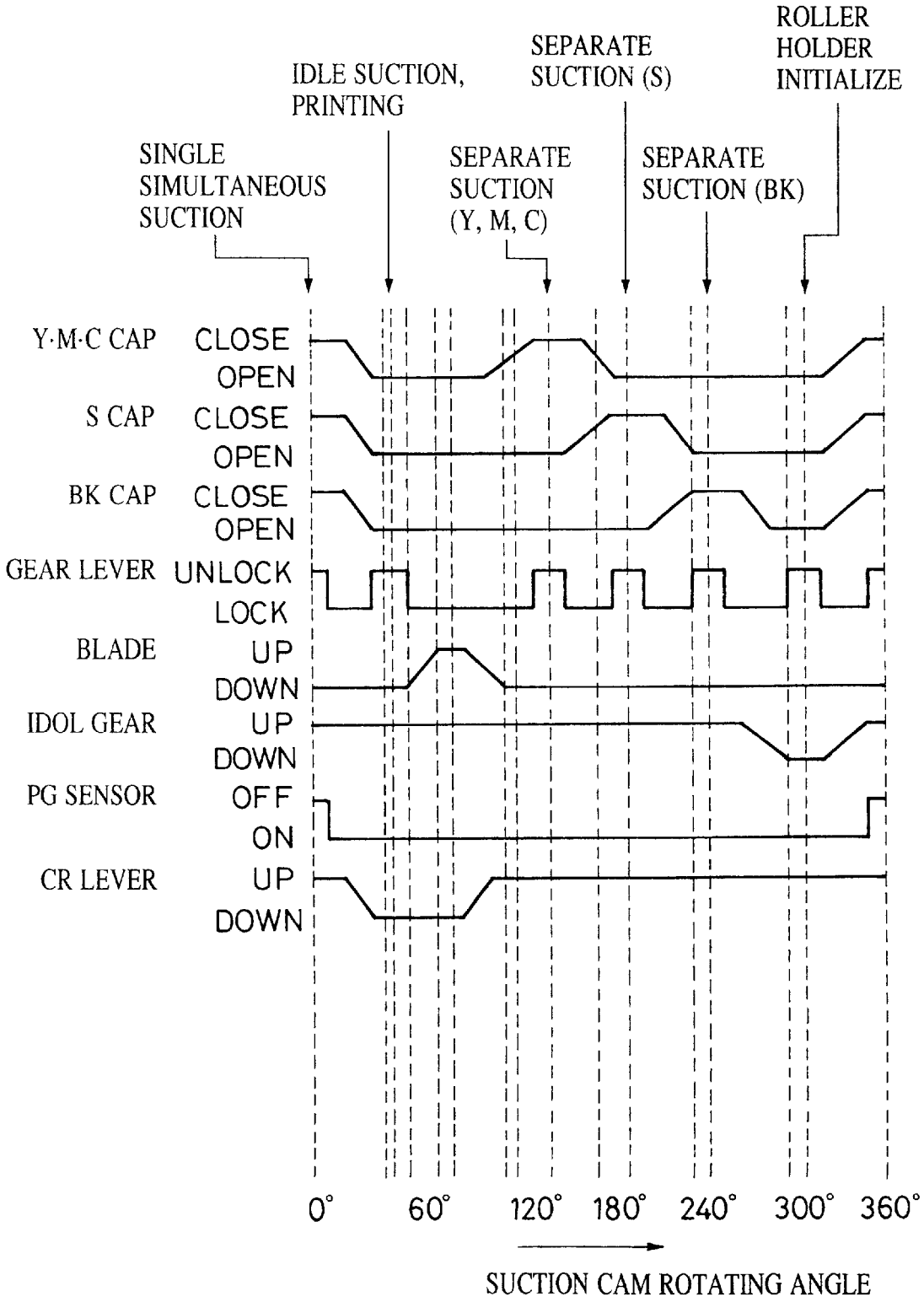
FIG. 7 shows a timing chart of the operation of the recovery system of the inkjet recording apparatus of Embodiment 1 of the present invention.

These operations are performed by controlling the rotational angle of the suction cam 140, as shown in the timing chart of FIG. 7.

It is possible to move each cap separately and vertically by controlling the rotational angle of the suction cam 140 such that, during black ink suction recovery of the recording head, only the black ink cap 112 contacts the recording head, as shown in FIG. 6A; during processing liquid suction recovery of the recording head, only the processing liquid cap 113 contacts the recording head, as shown in FIG. 6B; and during color ink suction recovery of the recording head, only the color cap 114 contacts the recording head, as shown in FIG. 6C. With the proper cap in contact with the recording head, suction can be separately performed for each head portion by operating the tube pump.

These capping operations are also performed by controlling the rotational angle of the suction cam (FIG. 7).

Returning back to FIG. 4, the recovery unit 15 comprises, as wiping means, a processing liquid blade 117 for wiping the discharging opening (nozzle face) of the processing liquid recording head portion, and a color ink blade 118 for wiping the discharging openings (nozzle faces) of the black ink and color ink recording head portions. The processing liquid blade 117 and the color ink blade 118 are separated from each other by the recovery system base 130.

These blades 117 and 118 are made of elastic material, such as rubber, and are used to wipe off color ink and processing liquid on the discharging opening faces of the recording head. Blade arms 142 and 143, which are rotatably and axially secured to the recovery system base 130, are mounted to the blades 117 and 118, respectively. Portions of the blade arms 142 and 143, which are pulled by their respective springs 142SP and 143S, contact a cam face (not shown) of the suction cam 140. When a portion of each blade arm slides along the cam face (not shown) of the suction cam 140 as a result of the rotation of the suction cam 140, each blade moves vertically upward to wipe the recording head surface and downward so as not to interfere with the recording head surface. The position of the blade is controlled by the rotational angle of the suction cam (FIG. 7).

In order to prevent the ink from solidifying due to mixing of the color ink and the processing liquid at the vicinity of the discharging opening face of the recording head when wiping is performed, the processing liquid blade 117 for wiping the processing liquid discharging portion and the color ink blade 118 for wiping the color ink discharging portion are provided separately in order to allow the blades to move separately in the vertical dimension.

Wiping is performed with a blade at the raised position by moving the recording head.

Figure 8A:
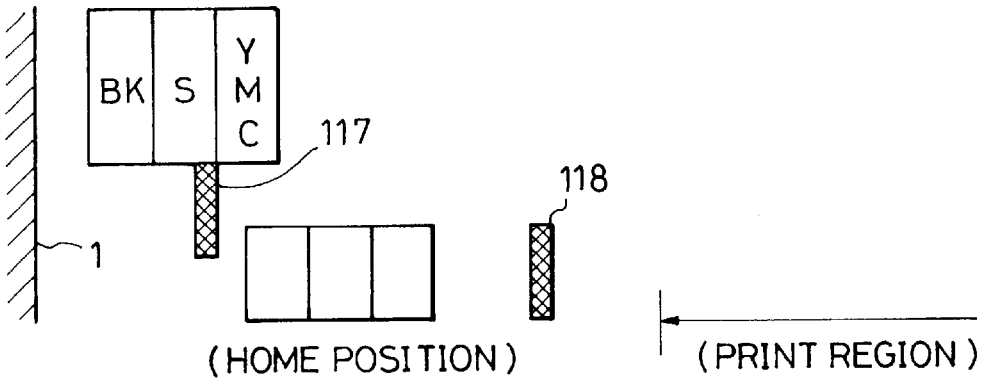
FIGS. 8A to 8C illustrate wiping operations in the inkjet recording apparatus of Embodiment 1 of the present invention.
Figure 8B:
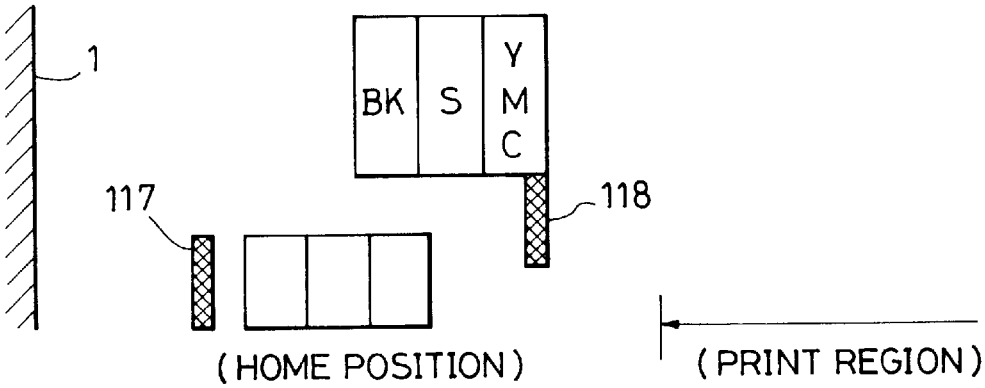
Figure 8C:
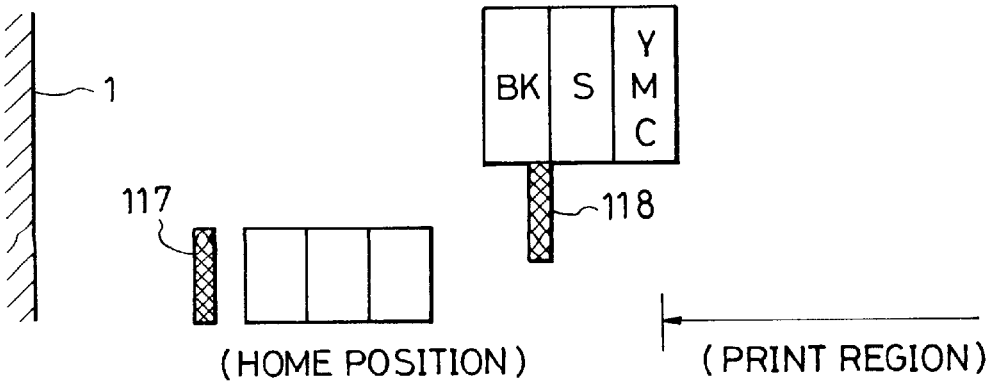

FIGS. 8A to 8C illustrate the wiping operations. FIG. 8A shows the processing liquid recording head portion being wiped. FIGS. 8B and 8C show the color ink recording head portions being wiped.

In the present embodiment, the color ink blade 118 is disposed at the right side of the recovery system base 130, or at the print region side, while the processing liquid blade 117 is disposed opposite to the color ink blade 118, or at the opposite side of the recovery system base 130, that is at the left side of the recovery base 130 or at the chassis side. Although the positions of the blades 117 and 118 may be reversed, this is not preferable when a plurality of color ink recording head portions are to be wiped, since the recording heads must be moved by a greater distance toward the left side of the recovery system base 130, that is toward the chassis side, which increases the width of the apparatus and thus prevents size reduction.

A description will now be given of the drive power transmission system which transmits drive power to the tube pump and the suction cam for controlling capping and wiping operations, with reference to FIGS. 9 to 12. FIGS. 9 to 12 illustrate the drive power transmission system in Embodiment 1 of the present invention.

Figure 9A:
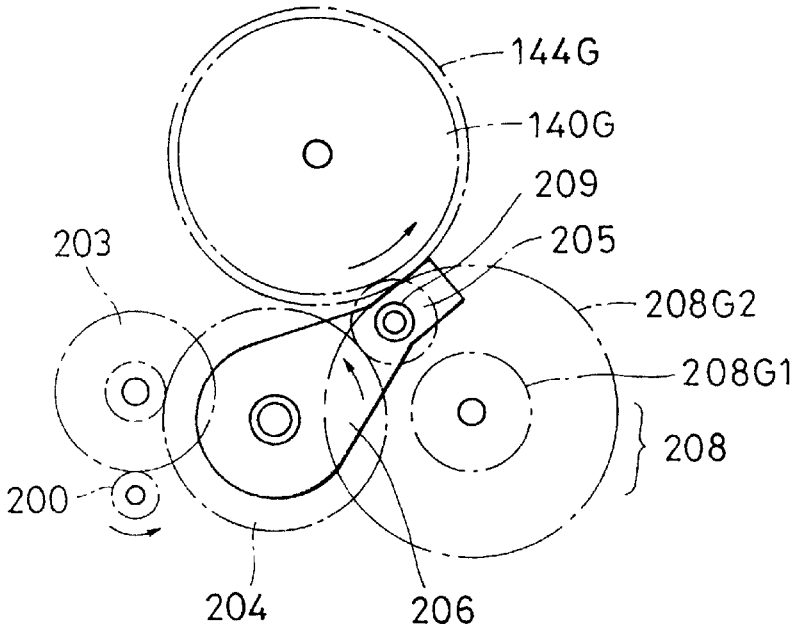
FIGS. 9A and 9B illustrate the drive power transmission mechanism for transmitting drive power to the recovery system of the inkjet recording apparatus of Embodiment 1 of the present invention.
Figure 9B:
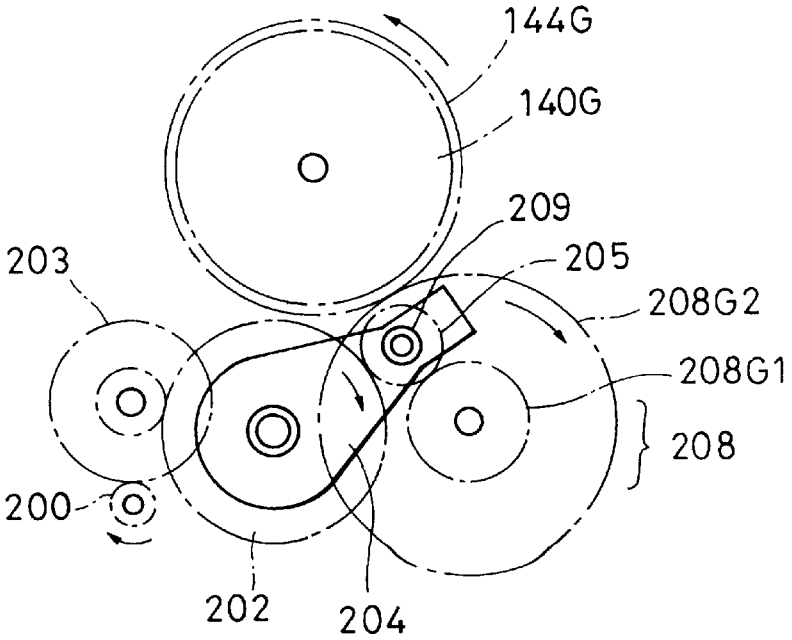
Figure 10:
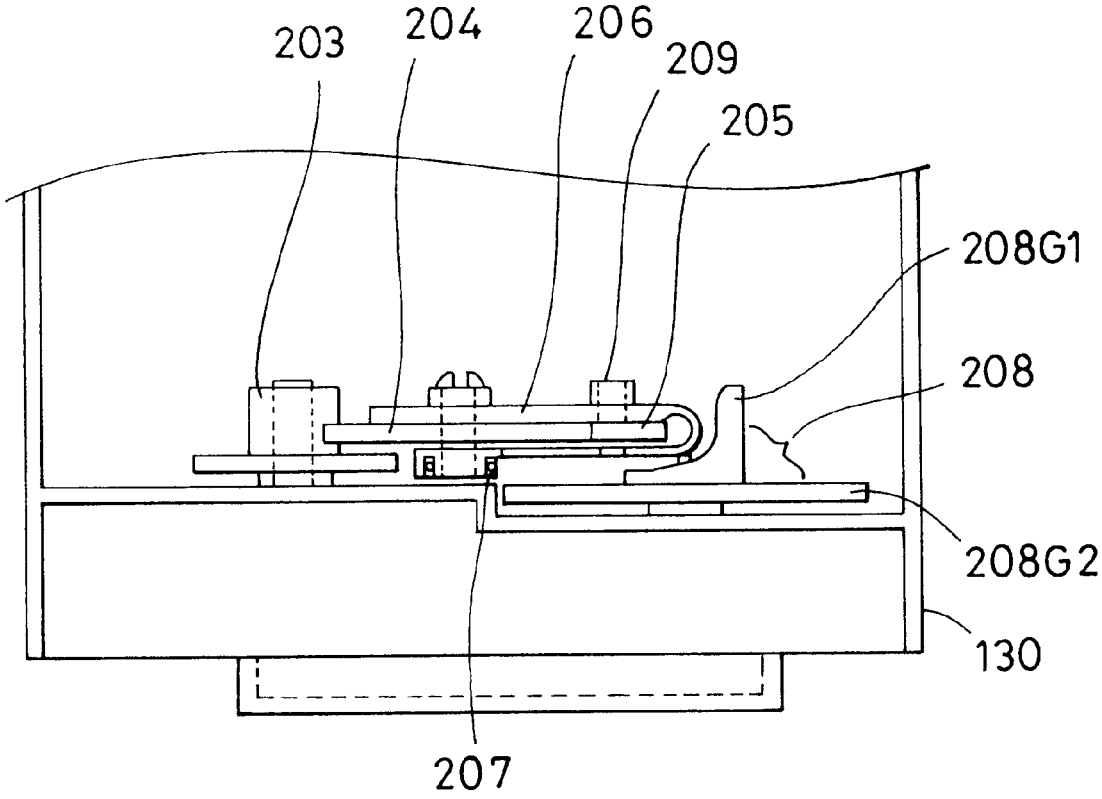
FIG. 10 illustrates the drive power transmission mechanism for transmitting drive power to the recovery system of the inkjet recording apparatus of Embodiment 1 of the present invention.

Referring to FIGS. 9 to 11, the output gear of a drive motor 200, the motor 200 being the drive source in the present invention, engages with a sun gear 204 via an idle gear 203. The sun gear 204 and a planetary gear 205 in mesh with the sun gear 204 are clamped with a gear lever 206, being a drive switching means, and are axially and rotationally secured to the gear lever 206. The sun gear 204 and the gear lever 206 are coaxially secured to the recovery system base 130. The portion of the gear lever 206 which axially supports the sun gear 204 is pressed by a gear lever spring 207 to generate friction force between it and the sun gear 204 clamped by the gear lever 206 (FIG. 10). When the sun gear 204 rotates by drive power transmitted thereto from the drive motor 200, the gear lever 206 rotates in the same direction due to friction forces, which in turn causes the planetary gear 205 to move in the same direction along the circumference of the sun gear 204.

When the planetary gear 205 moves counterclockwise around the axial center of the sun gear 204, it engages with a gear section 140G of the suction gear cam 140 axially and rotatably secured to the recovery system base 130, as shown in FIG. 9A, causing the suction cam 140 to rotate counterclockwise.

When the sun gear 204 is driven clockwise, the planetary gear 205 moves clockwise around the axial center of the sun gear 204 and meshes with a gear section 208G1 of the idle gear 208 rotatably and axially secured to the recovery system base 130 (FIG. 9B). When this occurs, the planetary gear 205 disengages from the gear section 140G of the suction cam 140. The other gear section 208G2 of the idle gear 208 meshes with the gear section 144G of the roller holder 144, which is rotatably and axially secured to the recovery system base 130, causing the roller holder 144 to rotate counterclockwise.

Accordingly, the capping and tube pump operations can be switched by switching the rotational directions of the drive motor 200.

A flange 207 projects from the vicinity of a bearing which axially supports the planetary gear 205 which is clamped by the gear lever 206. When the gear section 140G of the suction cam 140 engages with the planetary gear 205, the flange 209 is positioned along the inner wall of a rib 140R of the suction cam 140 (FIG. 11A), which prevents disengagement of the planetary gear 205 from the gear section 140G.

Figure 11A:
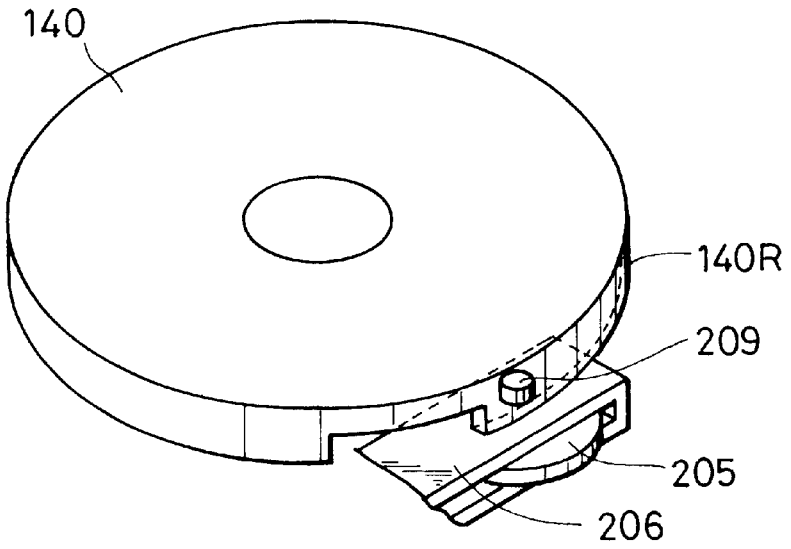
FIGS. 11A and 11B illustrate the drive power transmission mechanism for transmitting drive power to the recovery system of the inkjet recording apparatus of Embodiment 1 of the present invention.
Figure 11B:
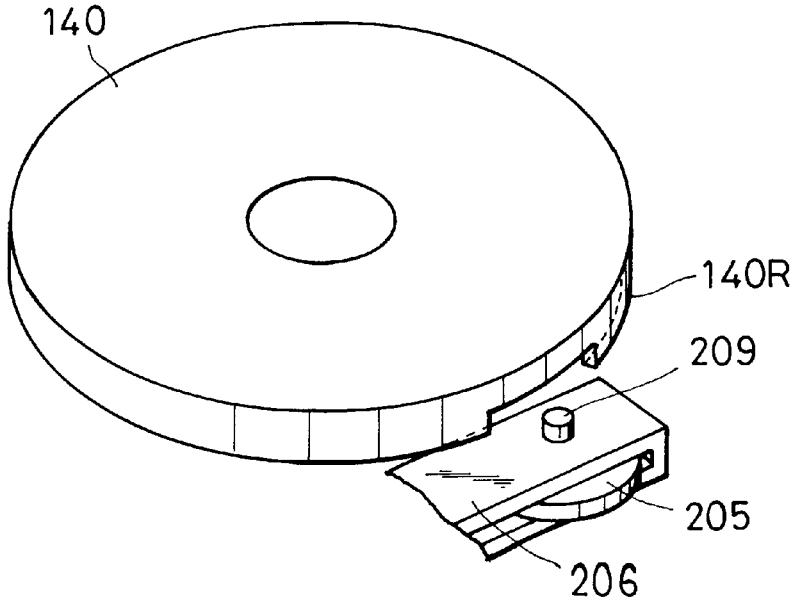

A portion of the rib 140R is cut out to allow the planetary gear 205 to move around the axial center of the sun gear 204 at the suction position of the suction cam 140 (FIG. 11B).

In the present embodiment, the home positions of the suction cam 140 and the roller holder 144 are set by an electrical sensor (not shown), such as a photo-interpreter.

As shown in FIGS. 4 and 12, a CR lever 160, acting as capping positioning means, is rotatably and axially secured to the recovery system base 130. One end of the CR lever 160 contacts the cam section of the suction cam 14 (capping control means) as a result of being urged by a CR lever spring 160SP, which allows the CR lever 160 to move vertically when the suction cam 140 rotates.

Figure 12A:
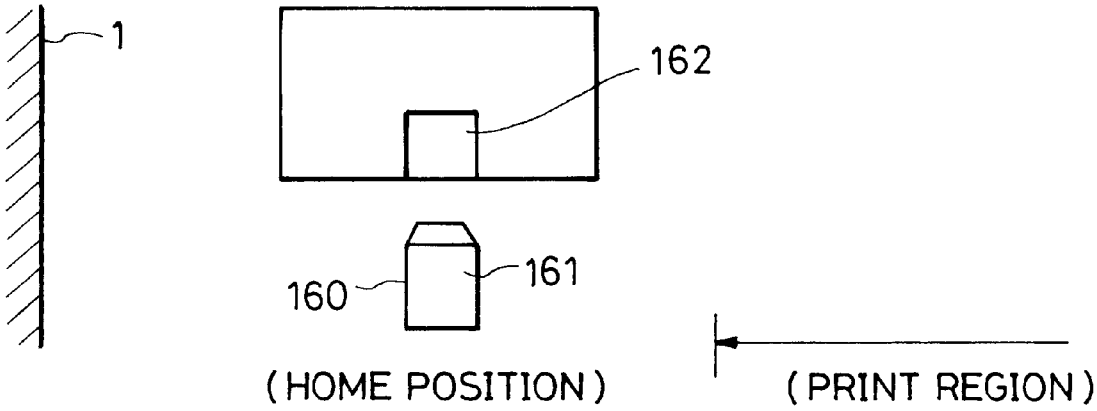
FIGS. 12A and 12B illustrate capping positioning means in the recovery system of the inkjet recording apparatus of Embodiment 1 of the present invention.
Figure 12B:
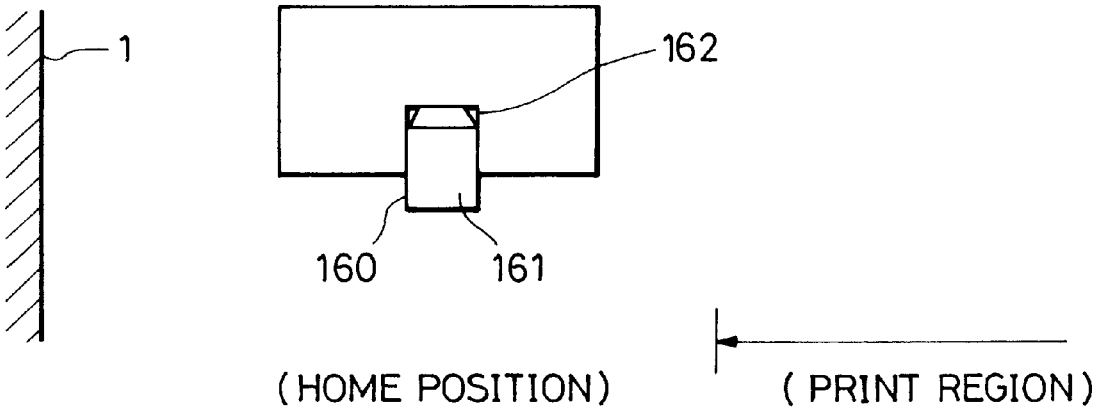

The CR lever 160 is controlled such that it is raised when the carriage 6 is at home position. Here, a protrusion 161 of the CR lever 160 fits into a recess 162 in the carriage or the recording head 8, whereby the position of contact of the recording head and the cap is defined (FIG. 12B) during capping. During printing, the CR lever 160 moves downward so as not to interfere with the movement of the carriage (FIG. 12A).

Embodiment 2

A description will now be given of Embodiment 2 of the present invention, with reference to FIGS. 13 to 17.

The present embodiment differs from Embodiment 1 in that the head construction includes five nozzles instead of three. More specifically, in the present embodiment, the C, M, and Y nozzles (of the color nozzle unit) disposed in a vertical row are formed as separate color nozzles, so that the recording head has five nozzles, a processing liquid nozzle, a black nozzle, a cyan nozzle, a magenta nozzle, and a yellow nozzle, formed into an integral structure. The tanks, carriage, and other component parts are essentially the same as those of the apparatus of Embodiment 1, so that they will not be described below.

Figure 13:
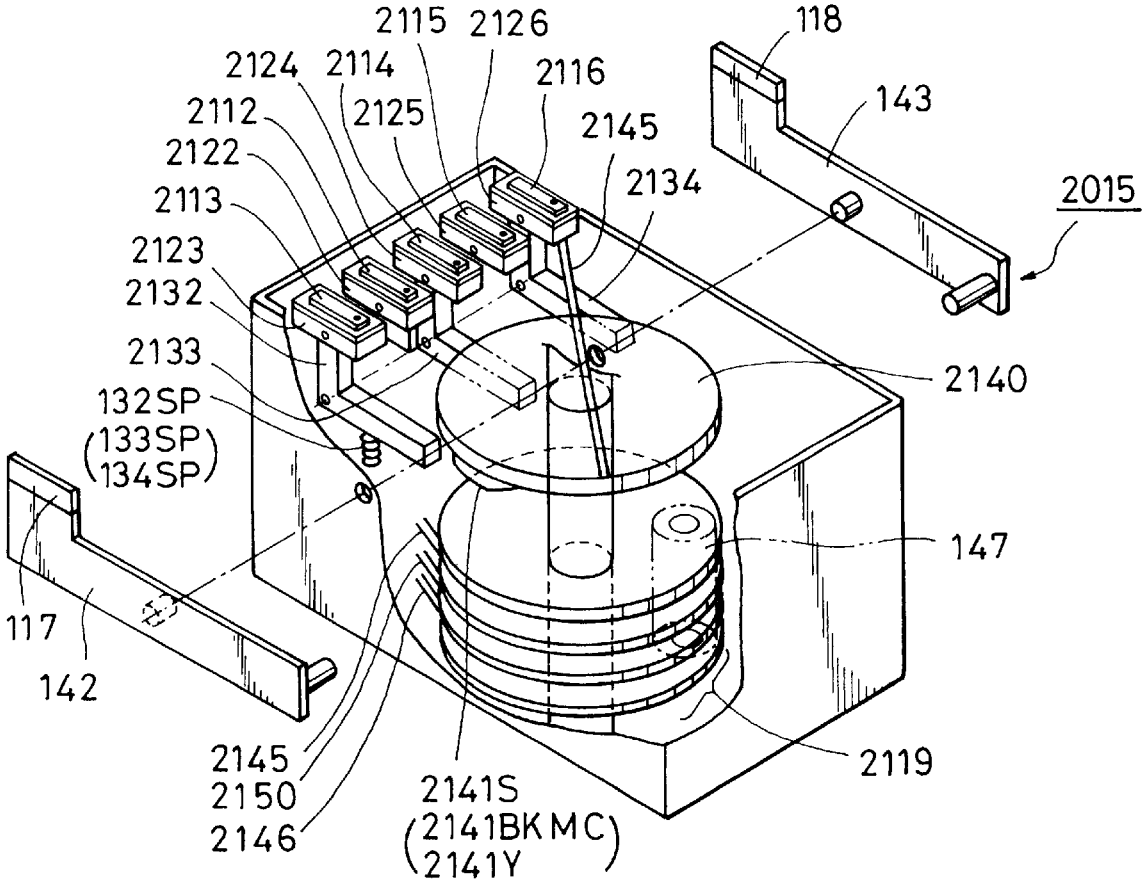
FIG. 13 is an exploded perspective view of the construction of the recovery system unit of an inkjet recording apparatus of Embodiment 2 of the present invention.

FIG. 13 is an exploded perspective view of the recovery system unit of the apparatus of Embodiment 2 of the present invention.

In the recovery system unit 2015 of FIG. 13, caps are provided in correspondence with the five nozzles of the recording head. They are, from the print region side, a yellow (Y) cap 2116, a magenta (M) cap 2115, a cyan (C) cap 2114, a black (BK) cap 2112, and a processing liquid (S) cap 2113.

The processing liquid cap 2113 and the yellow cap 2116 are used for separate suction and for merely capping the nozzles when suction is not performed. The black cap 2112, the cyan cap 2114, and the magenta cap 2115 are used for one-time simultaneous suction and for merely capping the nozzles when suction is not performed. The yellow cap 2116 may be used for separate suction of BK, C, and M recording liquid by moving the carriage, in addition to suction of Y recording liquid.

Figure 14A:
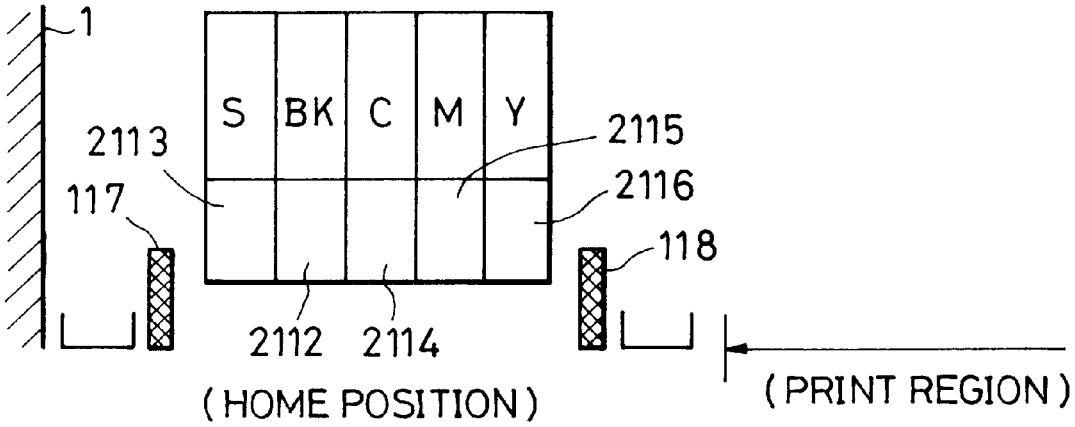
FIGS. 14A and 14B illustrate the operation of the recovery system of the inkjet recording apparatus of Embodiment 2 of the present invention.
Figure 14B:
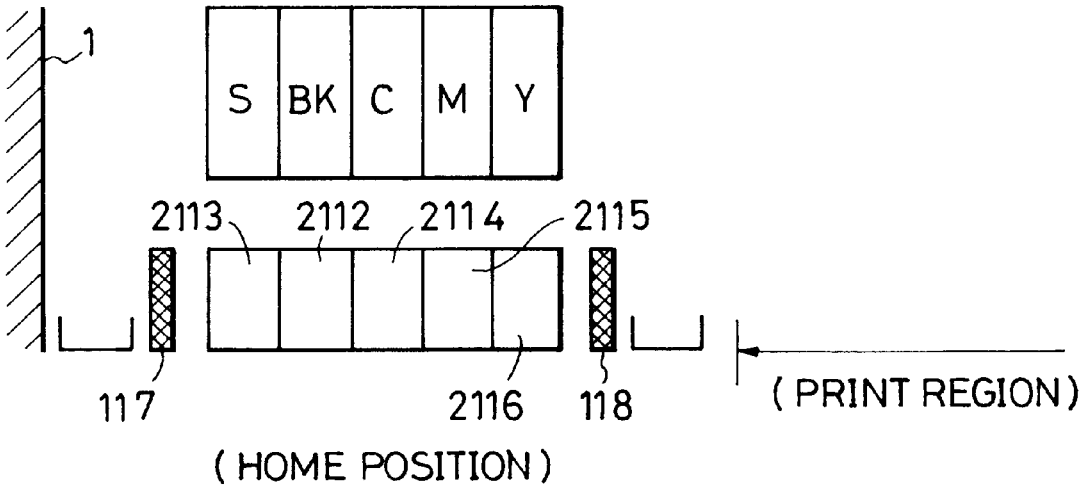
Figure 15A:
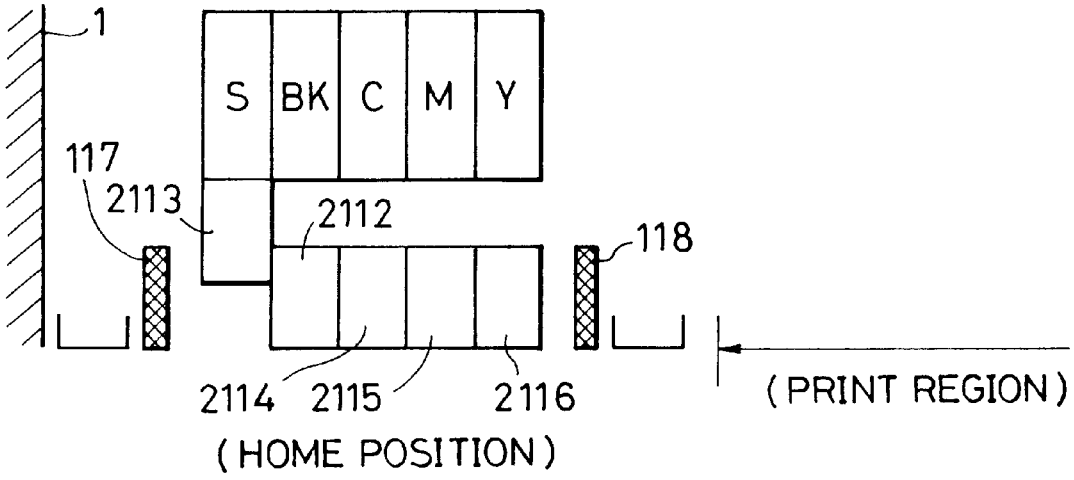
FIGS. 15A and 15B illustrate the operation of the recovery system of the inkjet recording apparatus of Embodiment 2 of the present invention.
Figure 15B:
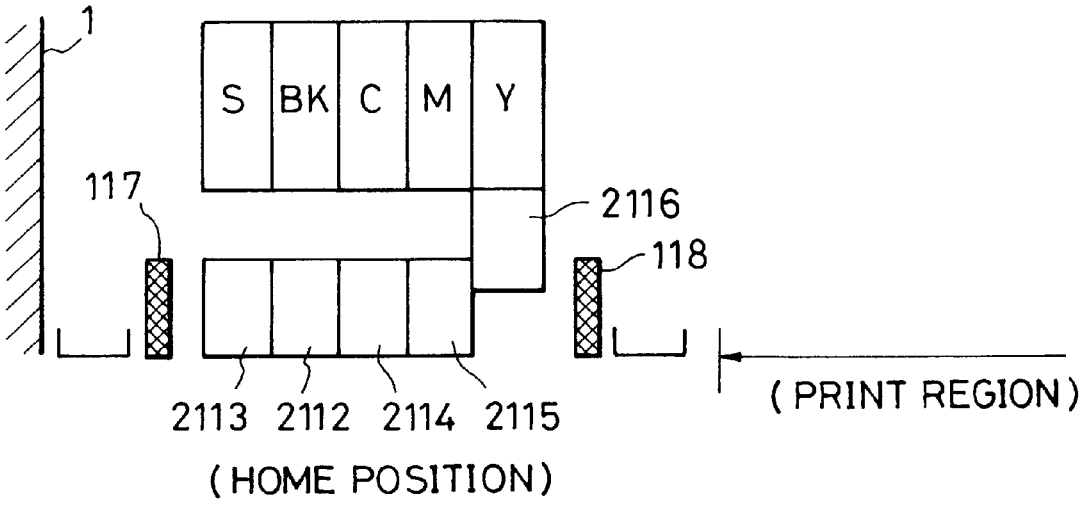

FIG. 14A shows the caps capping the nozzles. FIG. 14B shows the caps in a removed state. FIG. 15A shows the processing liquid being sucked. FIG. 15B shows yellow ink being sucked.

Figure 16A:
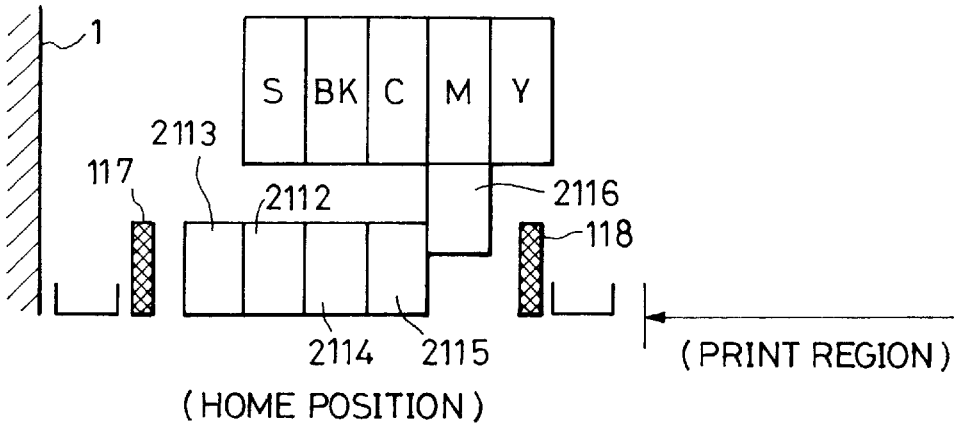
FIGS. 16A to 16C illustrate the operation of the recovery system of the inkjet recording apparatus of Embodiment 2 of the present invention.
Figure 16B:
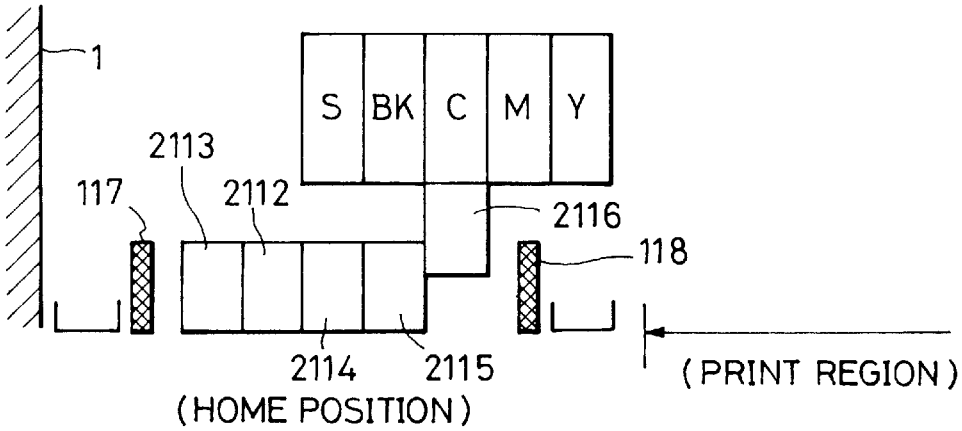
Figure 16C:
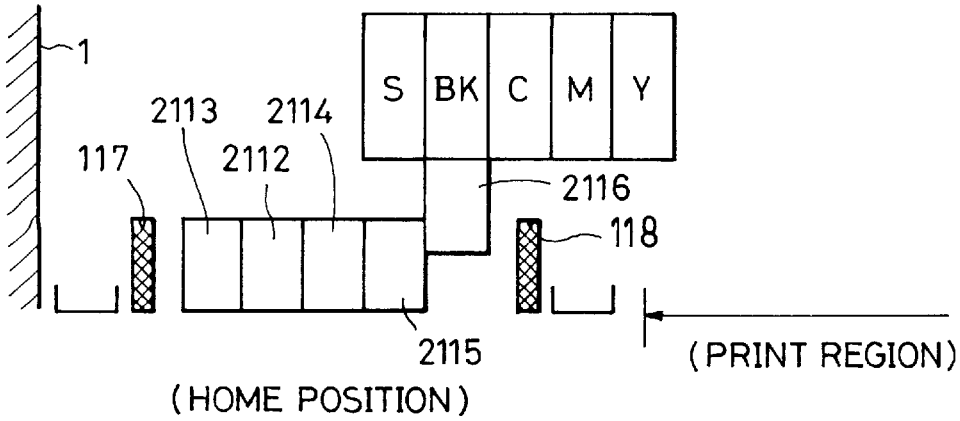

In the present embodiment, there is only one cap which can be used for separately sucking the different color ink types, so that suction of the other recording liquids (magenta ink, cyan ink, and black ink) are performed by moving the carriage and using the yellow cap 2116, as shown in FIGS. 16A, 16B, and 16C, respectively. One-time simultaneous suction is performed by the tube pump, with all of the nozzles capped, as shown in FIG. 14A.

The caps 2112 to 2116 are supported by cap holders 2122 to 2126, respectively. Cap levers 2132, 2133, and 2134 are rotatably and axially supported by the recovery system base 130. One cap holder 2123 is mounted to the cap lever 2132, the three cap holders 2122, 2124, and 2125 are mounted to the cap lever 2133, and one cap holder 2126 is mounted to the cap lever 2134.

The present embodiment differs from Embodiment 1 in that the cap holders 2122, 2124 and 2125 are simultaneously operated by the cap lever 2133.

The cap lever 2132, 2133, and 2134 are urged by cap lever springs 132SP, 133SP, and 134SP. The cap levers 2132, 2133, and 2134 partly contact their respective cam faces 2141S, 141BKMC, and 2141Y of the suction cam 2140. Therefore, when the suction cam 140 rotates, the cap levers 2132, 2133, and 2134 rotationally move vertically, which in turn causes the cap 2113, the cap set including caps 2112, 2114, and 2115, and the cap 2116 to move vertically.

Figure 17:
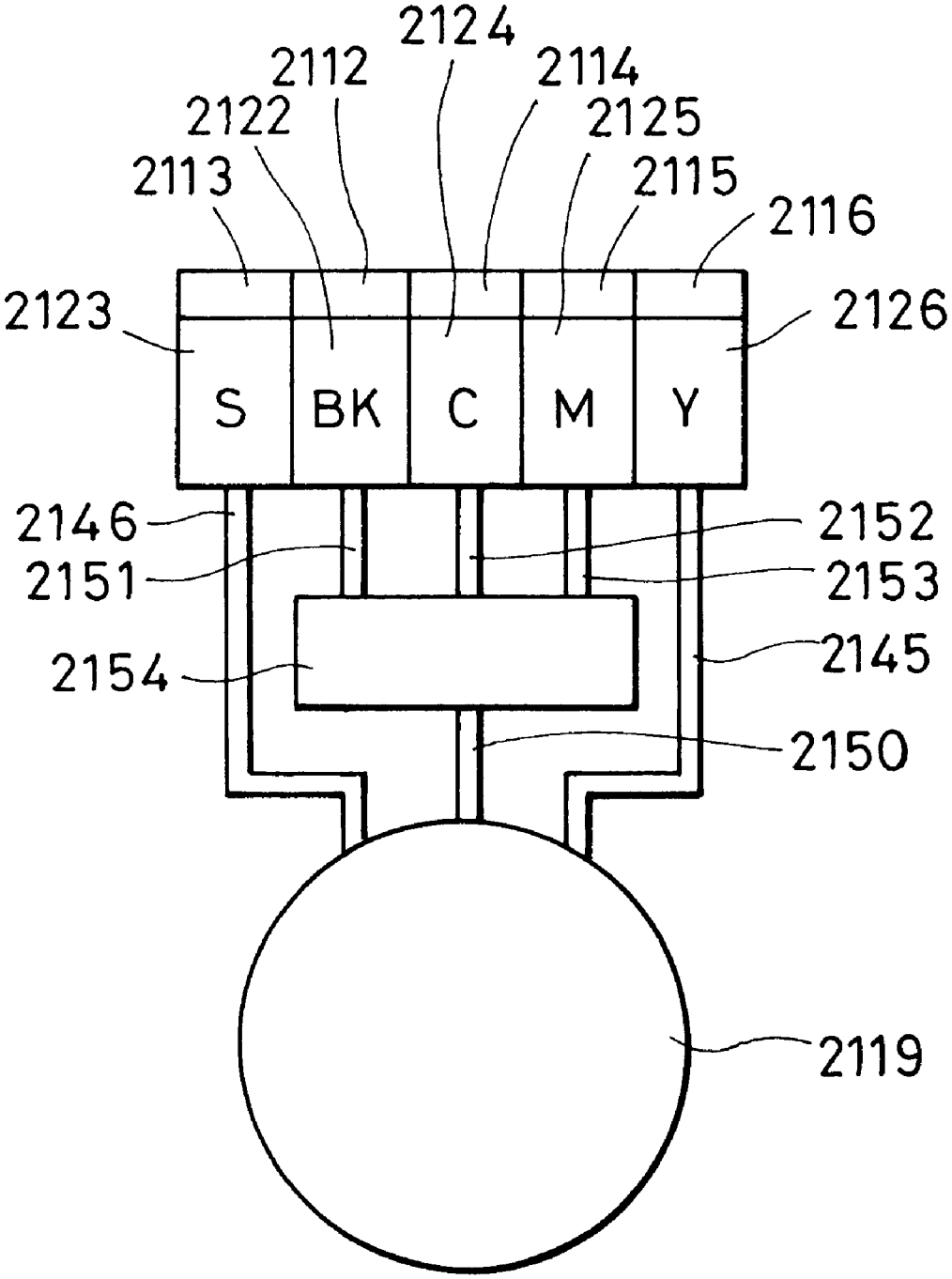
FIG. 17 illustrates the cap in communication with the pump unit in the recovery system unit of the inkjet recording apparatus of Embodiment 2 of the present invention.

The processing liquid cap 2113 and the yellow cap 2116 of the recovery system unit 2015 communicate with their respective tubes 2146 and 2145 of a pump unit 2119 via their respective cap holders 2123 and 2126. The black cap 2112, the cyan cap 2114, and the magenta cap 2115 communicate with a tube 2150 of the pump unit 2119 via their respective cap holders 2122, 2124, and 2125, their respective joint tubes 2151, 2152, and 2153, and a joint 2154 (FIG. 17).

The drive power transmission system for transmitting drive power to the recovery system unit is essentially the same as that described in Embodiment 1.

Embodiment 3

A description will now be given of the apparatus of Embodiment 3 of the present invention, with reference to FIGS. 18 to 20.

In Embodiment 1, the home positions of the suction cam 140 and the roller holder 144 are set with an electrical sensor, such as a photointerpreter. In the present embodiment, the electrical sensor is used only for setting the home position of the suction cam 140. The home position of the roller holder 144 is set by a mechanical structure.

Figure 18:
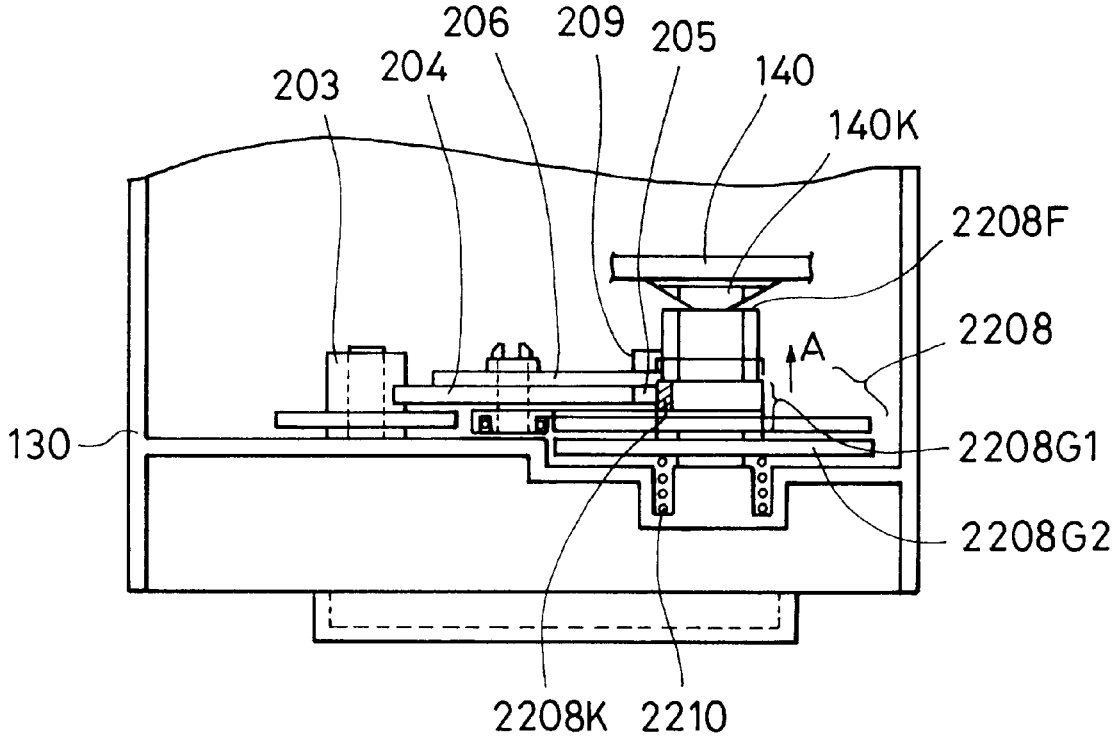
FIG. 18 illustrates the drive power transmission system of an inkjet recording apparatus of Embodiment 3 of the present invention.
Figure 19:
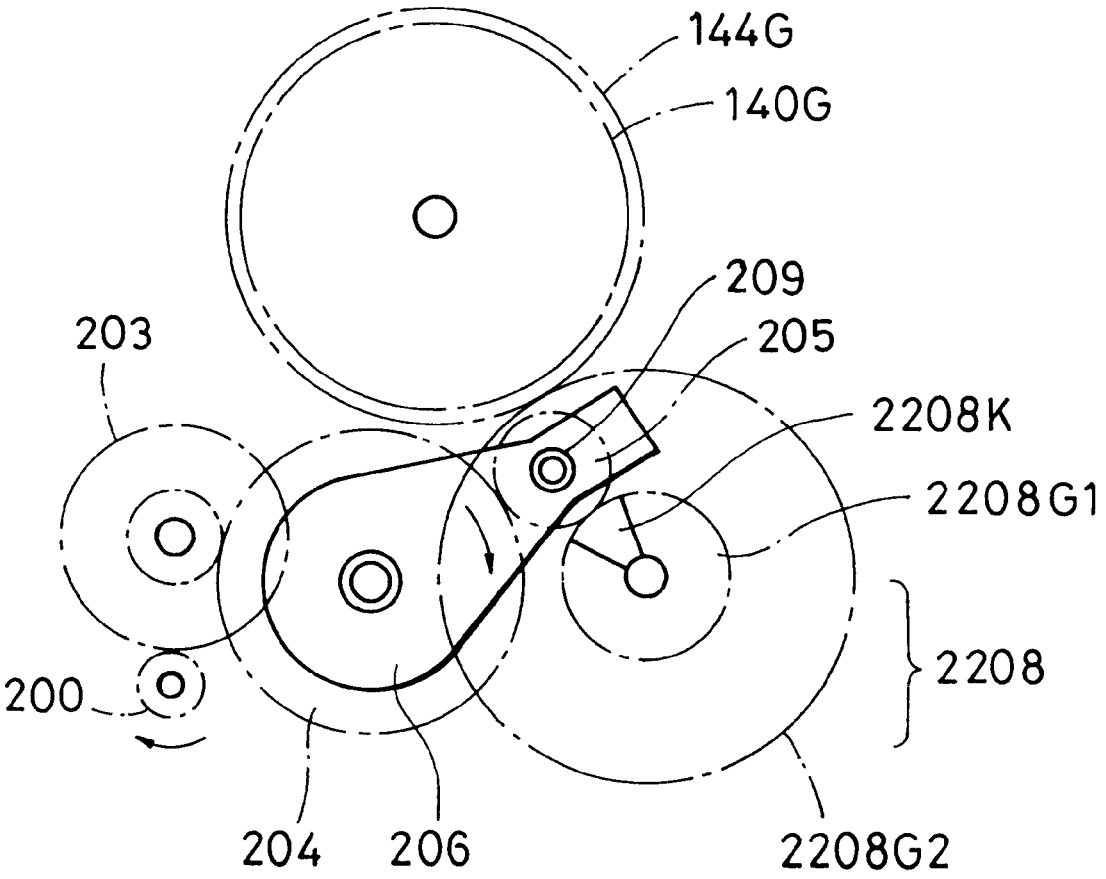
FIG. 19 illustrates the drive transmission system of the inkjet recording apparatus of Embodiment 3 of the present invention.

FIGS. 18 and 19 illustrate the drive power transmission system of the apparatus of Embodiment 3 of the present invention.

In FIGS. 18 and 19, an idle gear 2208, which receives drive power from the planetary gear 205 and transmits it to the gear section 144G of the roller holder 144, is rotatably and axially secured to the recovery system base 130 and is movable in the axial thrust direction. The idle gear 2208 is urged by the idle gear spring 2210 in the direction of arrow A, allowing the cam section 140K of the suction cam 140 to contact a flange 2208F of the idle gear 2208. Therefore, during rotation of the suction cam, the cam section 140K and the flange 2208F slide, allowing the idle gear 2208 to move vertically by means of the cam section 140K, with the section cam 140 set at any position.

A teeth-missing section, serving as drive interrupting means, is provided at a portion of the gear section 2208G1 of the idle gear 2208 engaging with the planetary gear 205. When the idle gear 2208 is raised upward, the teeth-missing section 2208K is disposed away from the level of the planetary gear 205, causing the gear section 2208G1 of the idle gear 2208 to engage with the planetary gear 203 to constantly transmit drive power. When the idle gear 2208 is lowered down to the level of the cam section 140K of the suction cam 140, the teeth-missing section 2208 moves to the level of the planetary gear 205, so that the idle gear 2208 does not transmit drive power to the gear section 144G of the roller holder 144 for a certain period of time. The roller holder 144 can be made to constantly stop at a specified position by forming the gear section 144G of the roller holder 144 and the gear section 2208G2 of the idle gear 2208 with the same number of teeth.

At the stopping position of the roller holder 144, specified as the home position thereof, the roller holder 144 is positioned such that it does not rotate.

Figure 20:
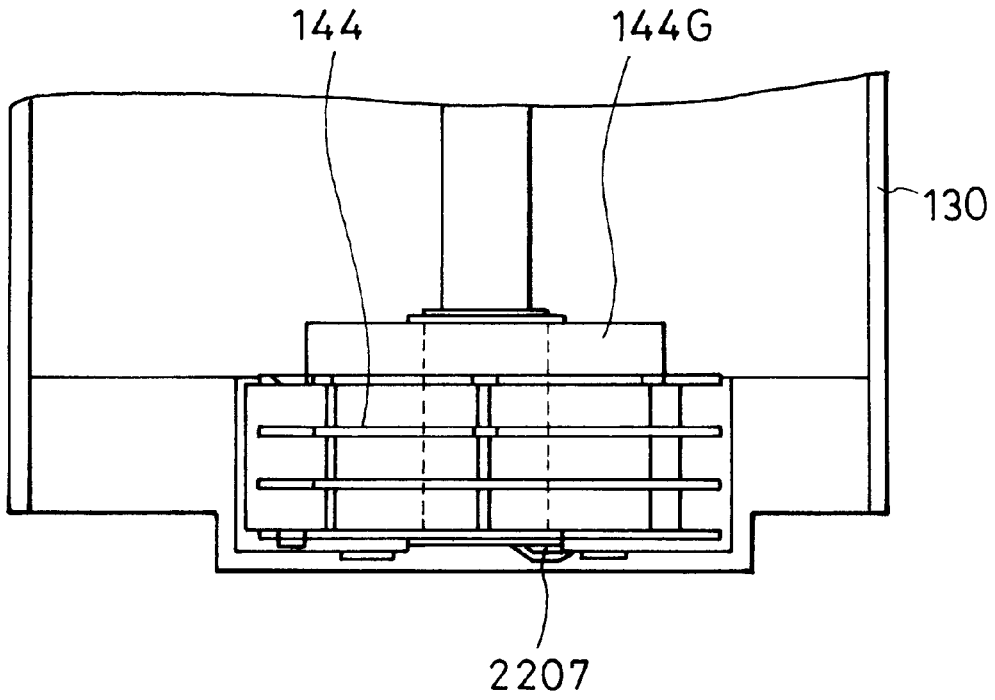
FIG. 20 illustrates the rotation control means of the roller holder of the inkjet recording apparatus of Embodiment 3 of the present invention.
Figure 21:
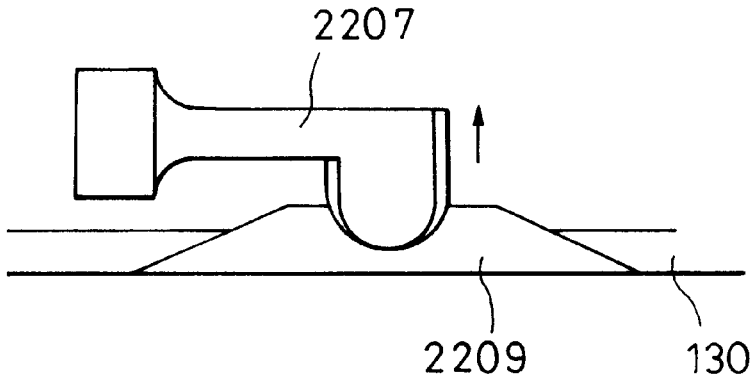
FIG. 21 illustrates the rotation control means of the roller holder of the inkjet recording apparatus of Embodiment 3 of the present invention.

FIGS. 20 and 21 illustrate rotation control means of the roller holder 144.

In the present embodiment, the rotation control means 2207, disposed at the bottom face of the roller holder 144, is an 20 elastic protrusion which fits into a recess 2209 formed in the recovery system base 130 such that it opposes the rotation control means 2207. Any external force less than the elasticity of the protrusion will not cause rotation of the roller holder 144, so that even when the idle gear 2208, due to the teeth-missing section 2208K, is out of engagement with the planetary gear 205, the home position of the roller holder 14 engaging with the idle gear 2208 will not move.

What is claimed is:

1. A liquid jet apparatus, comprising:

a recording head for discharging a recording liquid from a nozzle;

a cap for capping the nozzle of said recording head;

suction means for sucking the recording liquid from the nozzle when the nozzle is capped;

a drive source for generating a drive power to be used for driving said cap and said suction means; and a switching mechanism including a planetary gear for transmitting the drive power generated by said drive source to either said cap or said suction means, an axis of said planetary gear being movable in a plane substantially perpendicular to said axis of said planetary gear, wherein said drive source is driven in one direction to cause said cap to cap the nozzle, and is driven in a direction opposite to the one direction to cause said suction means to perform sucking.

2. A liquid jet apparatus according to claim 1 comprising a plurality of recording heads, wherein the suction is performed in a one-time suction mode where all of said plurality of recording heads are capped to perform suction by said suction means, a separate suction mode where each of said recording heads is separately capped to perform suction by said suction means, and an idle suction mode where all of said plurality of recording heads are kept uncapped to perform suction by said suction means.

3. A liquid jet apparatus according to claim 1 or 2, wherein all or at least one of said plurality of caps are used for suction and for maintaining humidity.

4. A liquid jet apparatus according to claim 1, wherein said suction means comprises an elastic tube, a pressure member for squashing said tube, and a pressure guide which backs up the squashing of said tube by said pressure member.

5. A liquid jet apparatus according to claim 1, further comprising wiping means for wiping the surface of the nozzle of said recording head, said wiping means wiping the surface of the nozzle using control means for controlling said cap.

6. A liquid jet apparatus according to claims 1 or 5, further comprising capping positioning means for defining a place of contact of said cap with said recording head, said capping positioning means operating by means of the control means of said cap.

7. A liquid jet apparatus according to claim 6, wherein said capping positioning means is fitted to a carriage for carrying said recording head, or to said recording head.

8. A liquid jet apparatus according to claim 1, wherein said switching mechanism does not drive said suction means when said cap is in operation, and does not drive said cap when said suction means is in operation.

9. A liquid jet apparatus according to claim 8, further comprising drive interrupting means disposed in a path of the drive power for transmitting drive power to said switching mechanism and said suction means, said drive interrupting means interrupting transmission of the drive power to said suction means at any position.

10. A liquid jet apparatus according to claim 9, wherein said drive interrupting means operates in conjunction with a control means for controlling said cap.

11. A liquid jet apparatus according to claim 1, wherein said recording head includes an electrothermal converter for generating thermal energy to discharge the recording liquid from the nozzle.

12. A liquid jet apparatus according to claim 1, wherein the recording liquid includes a processing liquid which reacts with ink.

13. A recovery apparatus for use in a liquid jet apparatus having a recording head for discharging a recording liquid from a nozzle, the recovery apparatus comprising:

a cap for capping the nozzle;

suction means for sucking the recording liquid from the nozzle when the nozzle is capped;

a drive source for generating a drive power to be used for operating said cap and said suction means; and a switching mechanism including a planetary gear for transmitting the drive power generated by said drive source to either said cap or said suction means, an axis of said planetary gear being movable in a plane substantially perpendicular to said axis of said planetary gear, wherein said drive source is driven in one direction to cause said cap to cap the nozzle, and is driven in a direction opposite to the one direction to cause said suction means to perform sucking.

* * * * *

UNITED STATES PATENT AND TRADEMARK OFFICE

CERTIFICATE OF CORRECTION

PATENT NO. : 6,402,289 B2
DATED : June 11, 2002
INVENTOR(S) : Nitta

It is certified that error appears in the above-identified patent and that said Letters Patent is hereby corrected as shown below:

Title page,
Item [56], References Cited, U.S. PATENT DOCUMENTS, please insert:

| | | | | |
|---|---|---|---|---|
| -- 5,831,644 | 11/1998 | Kato | 347 | 22 |
| 4,825,231 | 4/1989 | Nozaki | 347 | 30 |
| 5,182,582 | 1/1993 | Okamura | 347 | 30 -- |

Column 3,
Line 40, “ink” should read -- “ink” --.

Column 4,
Line 18, “supports” should read -- support --; and
Line 62, “order” should read -- order to --.

Column 8,
Line 21, “lever” should read -- levers --.

Column 9,
Line 19, “20” should be deleted; and
Line 46, “claim 1” should read -- claim 1, --.

Column 10,
Line 11, “claims 1” should read -- claim 1 --.

Signed and Sealed this

Twenty-fourth Day of June, 2003

JAMES E. ROGAN
*Director of the United States Patent and Trademark Office*